United States Patent [19]

Niewald et al.

[11] Patent Number: 4,600,354

[45] Date of Patent: Jul. 15, 1986

[54] MULTIPLE-USE UTILITY JACK AND TIRE CHANGING TOOL

[76] Inventors: Jack L. Niewald, P.O. Box 224, Clinton St.; Eugene W. Kelch, R.R., both of Corwith, Iowa 50430

[21] Appl. No.: 635,241

[22] Filed: Jul. 27, 1984

Related U.S. Application Data

[63] Continuation-in-part of Ser. No. 579,349, Feb. 13, 1984.

[51] Int. Cl.[4] ..... B66F 9/12

[52] U.S. Cl. ..... 414/607; 414/724; 414/912; 414/910

[58] Field of Search ..... 414/426, 427, 428, 433, 414/607, 724, 912, 608, 910, 911

[56] References Cited

U.S. PATENT DOCUMENTS

| | | | |
|---|---|---|---|
| 1,591,193 | 7/1926 | Weaver | 414/428 X |
| 2,217,898 | 10/1940 | Gemmill | 414/429 X |
| 2,878,703 | 3/1959 | Easton | 414/427 X |
| 3,705,658 | 12/1972 | Harris | 414/607 |
| 4,022,341 | 5/1977 | Lindquist | 414/426 |
| 4,242,035 | 12/1980 | Hornstein | 414/912 X |

*Primary Examiner*—Robert J. Spar
*Assistant Examiner*—Stuart J. Millman
*Attorney, Agent, or Firm*—Zarley, McKee, Thomte, Voorhees & Sease

[57] ABSTRACT

A multiple-use utility jack and tire changing tool which includes a base framework which is movable along the ground for application of a number of different attachment tools. An elongated mast extends upwardly from the base framework and has a masthead which is movable along the mast. The masthead has supports positioned along its vertical length for selective height-wise placement of attachments. These attachments include but are not limited to an assembly for rotatably supporting a vehicle tire, a fork, a fork with a V-bar addition, a boom, and an elbow lift. The assembly for rotatably supporting a vehicle tire includes an outwardly extending arm having at its end two tandem wheels which are aligned in the same plane and have rotational axes parallel to one another in a horizontal plane. The tandem wheels engage the top and side of the rim of the vehicle tire and cause the vehicle tire to be lifted when the masthead is lifted. When lifted, the tire may be rotated because it is supported only by the rotatable tandem wheels. The masthead is lifted by a jack. Additionally, the assembly for rotatably supporting a vehicle tire can be used separately from the base framework by attaching it to a conventional front end loader or forklift of an external motive power source.

14 Claims, 15 Drawing Figures

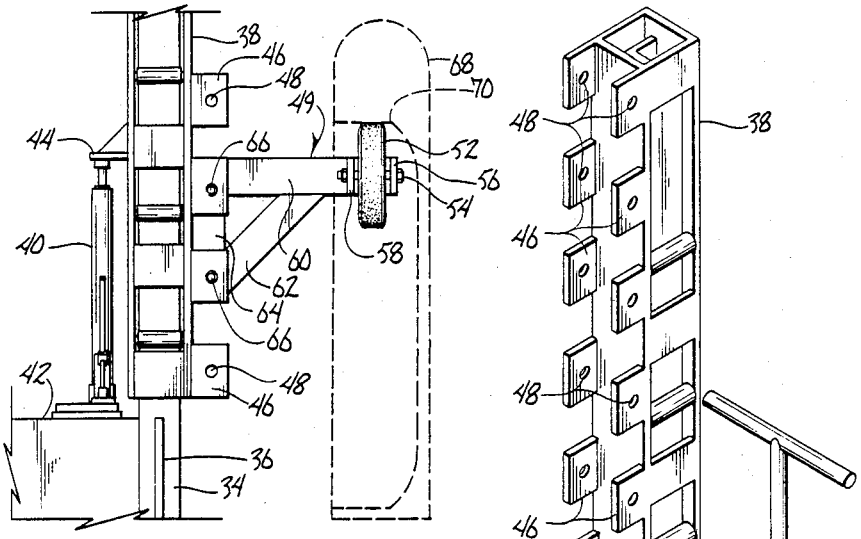
Fig. 3
Fig. 1
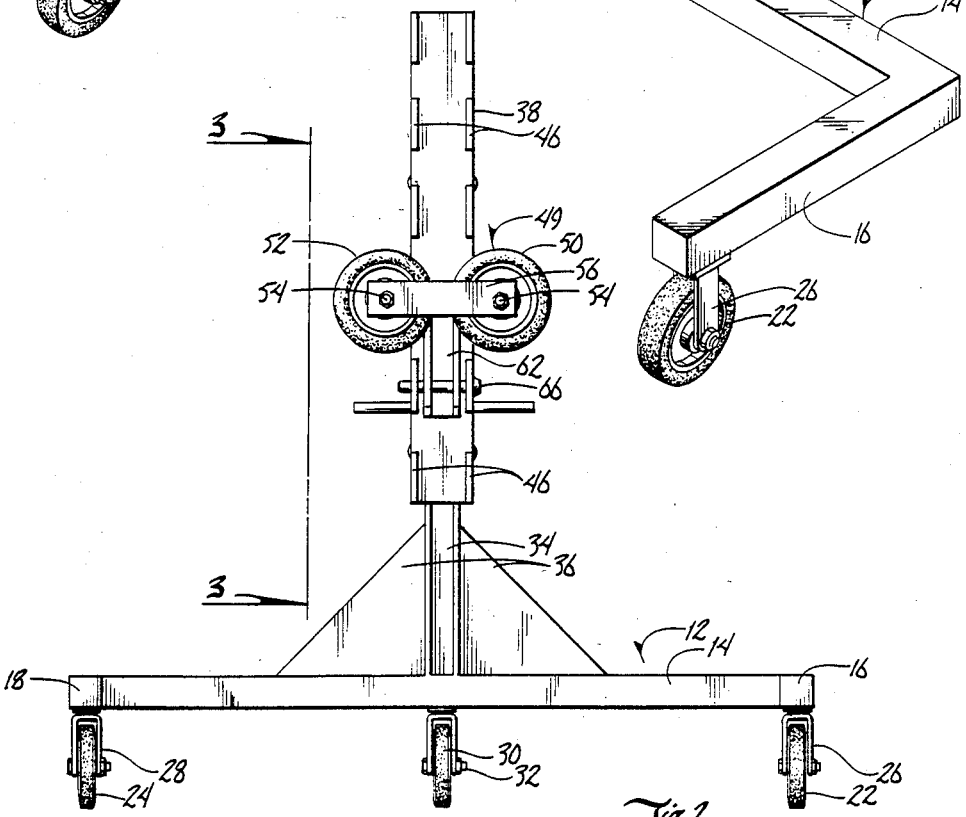
Fig. 2

38
46
48
44
136
138
142
40
134
140
42
12
20
34
36
18
30
32
128
130
126
28
24
132
178
174
176
172
180
164

38
46
166
178
172
146
152
150
168
176
180
164
144
46
170

38
46
170
166
15
144
176
46
48
168
172
164
180
15
178
156
152
150
46
146
154
148
160
158
162

MULTIPLE-USE UTILITY JACK AND TIRE CHANGING TOOL

RELATED APPLICATION

This application is a continuation-in-part to a copending application by the same inventors, namely, U.S. Ser. No. 579,349, entitled Mechanism For Lifting Tires, filed Feb. 13, 1984, now Pat. No. 4,571,142.

BACKGROUND OF THE INVENTION

1. Field of the Invention

This invention relates to a multiple-use utility jack tool, more particularly, to a mechanism for performing a variety of mechanical functions utilizing interchangeable and/or isolated usable tools.

2. Problems in the Art

Maintenance and repair of large vehicles many times involves tasks wherein the mechanic requires assistance in moving, lifting, or supporting parts of the vehicle. For example, tires for farm tractors present particular handling problems because of their size and weight. The large drive wheels for farm tractors from time to time must be removed, transported, or rotated, and must be lifted for these purposes. In particular, a problem arises in the handling of dual tractor wheels, in that the outside dual wheels of the tractor are added and removed depending on the selected use of the tractor.

Furthermore, final drives for tractors from time to time need to be removed and/or replaced requiring support and adjustment for positioning while performing these tasks. Axles and drive shafts also need to be supported when performing maintenance or repair and this cannot be accomplished by the mechanic alone.

Other tasks around the shop or machine shed necessitate tools for lifting and raising various parts, other tools, or miscellaneous objects which then many times must be transported to another location.

At other times, there is a need to have the wheel supporting mechanism portable and independent of the jack mechanism so that it can be attached to a conventional front end loader or forklift and be used with an auxiliary lifting and power source either locally or remotely.

It is therefore an object of this invention to provide a multiple-use utility jack and tire changing tool which solves or improves upon the deficiencies in the art.

A further object of this invention is to provide a multiple-use utility jack and tire changing tool which allows a variety of beneficial tools to be quickly interchanged or used.

Another object of this invention is to provide a multiple-use utility jack and tire changing tool which combines vertically adjustable support with portability.

A further object of this invention is to provide a multiple-use utility jack and tire changing tool which can be itself adjusted for various uses, and for each use, for various heights.

Another object of this invention is to provide a multiple-use utility jack and tire changing tool which is durable, economical, and cost efficient.

A further object of this invention is to provide a tire changing tool which can be used with a front end loader or fork lift.

Additional objects, features and advantages of the invention will become apparent with reference to the accompanying drawings and description.

SUMMARY OF THE INVENTION

This invention utilizes in one embodiment, a base framework having ground contacting means to allow easy movement along the ground. A super structure extends upwardly from the base framework which includes a mast which has a vertically adjustable masthead attached thereto.

The masthead itself has along its length means for securing any of a variety of attachment tools thereto.

A jack means is secured to the base framework and abuts the masthead so that upon operation of the jack, the masthead and the attendant attachment tool can be selectively raised or lowered.

The base framework has the ability to be selectively positioned and moved along the ground. The various attachments to the masthead thus can be used to perform their function and then the whole unit with, or without the part being worked on, can be transported to a different location.

The jack means allows for the vertical adjustability of the masthead. The vertical height adjustability of the masthead is thus limited by the extension limits of the jack. A plurality of attachment means along the vertical length of the masthead provides additional optional height adjustment. Each attachment tool can be selectively positioned on the masthead from any position either near the top all the way to the bottom. Therefore, for different uses, different initial heights can be selected.

The selection of attachment tools includes a rotatable supporting means for vehicle tires, a boom, a forklift, a forklift with a V-bar addition, and an elbow lift. Other attachment tools are, of course, possible.

The rotatable vehicle tire support consists of an extension means from the masthead to a tire contacting means which has two side-by-side rotatable wheels which are disposed in the same vertical plane and have rotational axes disposed in the same horizontal plane. The two rotatable wheels are positionable on the top of the inside rim of the vehicle tire and allow the vehicle tire to be raised and supported while at the same time being rotated. This tool usually facilitates the changing of vehicle tires, especially the outer dual wheels of farm tractors.

The boom attachment tool simply comprises a conventional boom having a line and hook extending from its outermost end. The boom can then be lifted by operation of the jack and masthead concurrently lifting anything attached to the line and hook.

A standard forklift can also be attached to the masthead to be vertically adjustable with respect to the ground. By adding a V-bar addition, comprising a crossbar and V-shaped supports, a vehicle tire such as a tractor tire can be supported on the forklift and retained by resting the tire against the crossbar and securing a chain from both ends of the crossbar around the middle section of the tire.

The elbow lift basically consists of a pivotable outwardly extending arm on which are grasping means. The grasping means consists either of some sort of plate member at the outer end of the arm to be bolted on or otherwise grasp a mechanism such as a final drive mechanism of a farm tractor. An additional embodiment includes a circular ring attached below the arm for surrounding and supporting such things as a vehicle axle or drive member. The elbow lift can be vertically adjusted by a ratchet means which is connected at one end to the outer end of the arm and at its other end to a bar which is hingably attached above the arm on the masthead.

It is sometimes advantageous to utilize the rotatable tire support attachment tool separate from the base framework and jack. This can be accomplished by utilizing the same vehicle tire contacting means with the two side-by-side rotatable wheels in an embodiment in which they can be secured to a conventional front end loader or forklift attachment for an auxiliary motive and lifting means. This can be accomplished by having a simple framework into which can be inserted the tines of a conventional forklift or to which can be secured the bucket of a conventional front end loader and then secured by a means such as a chain with a load binder.

BRIEF DESCRIPTION OF THE DRAWINGS

FIG. 1 is a perspective view of the base framework of the invention.

FIG. 2 is a front elevational view of the invention of FIG. 1 with a rotatable tire support attachment tool secured thereto.

FIG. 3 is a partial side view taken along line 3—3 of FIG. 2.

DETAILED DESCRIPTION OF THE PREFERRED EMBODIMENT

Figure 4:
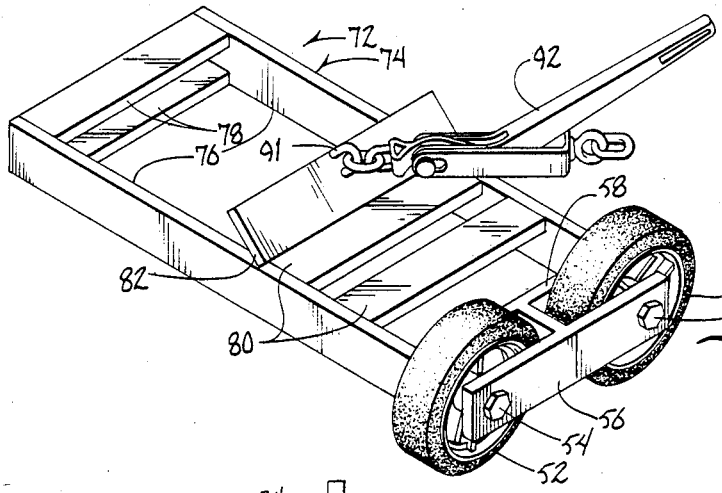
FIG. 4 is a perspective view of the individually utilizable rotatable wheel support attachment tool.

In reference to the drawings, and particularly FIG. 1, there is shown a base framework 12 in accordance with the invention. Base framework 12 is comprised of an elongated center piece 14 having end arms 16 and 18 extending perpendicularly from opposite ends of center piece 14, and a middle arm 20 extending perpendicularly in an opposite direction to end arms 16 and 18 from the middle of center piece 14. Wheels 22 and 24 are rotatably attached to yokes 26 and 28 which are in turn secured to end arms 16 and 18 respectively. Wheel 30 is rotatably attached to swivelable yoke 32 which is attached to middle arm 20. All wheels 22, 24 and 30 extend downwardly from framework 12 and contact the ground to allow the invention 10 to be easily moved along the ground. The swivelability or pivotability of yoke 32 allows the invention 10 to be steered as it is moved and maneuvered to a desired position.

Figure 9:
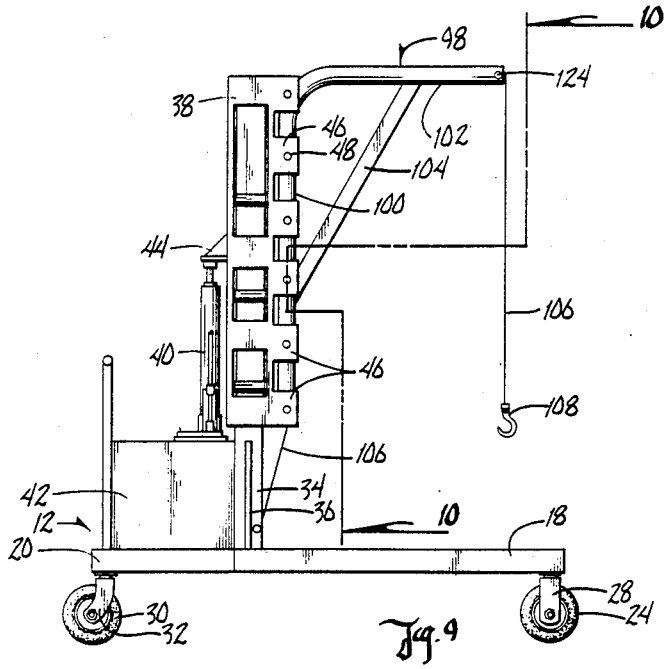
FIG. 9 is a side view of the device of FIG. 2 with a boom attachment tool.
Figures 12, 13, 14, 15:
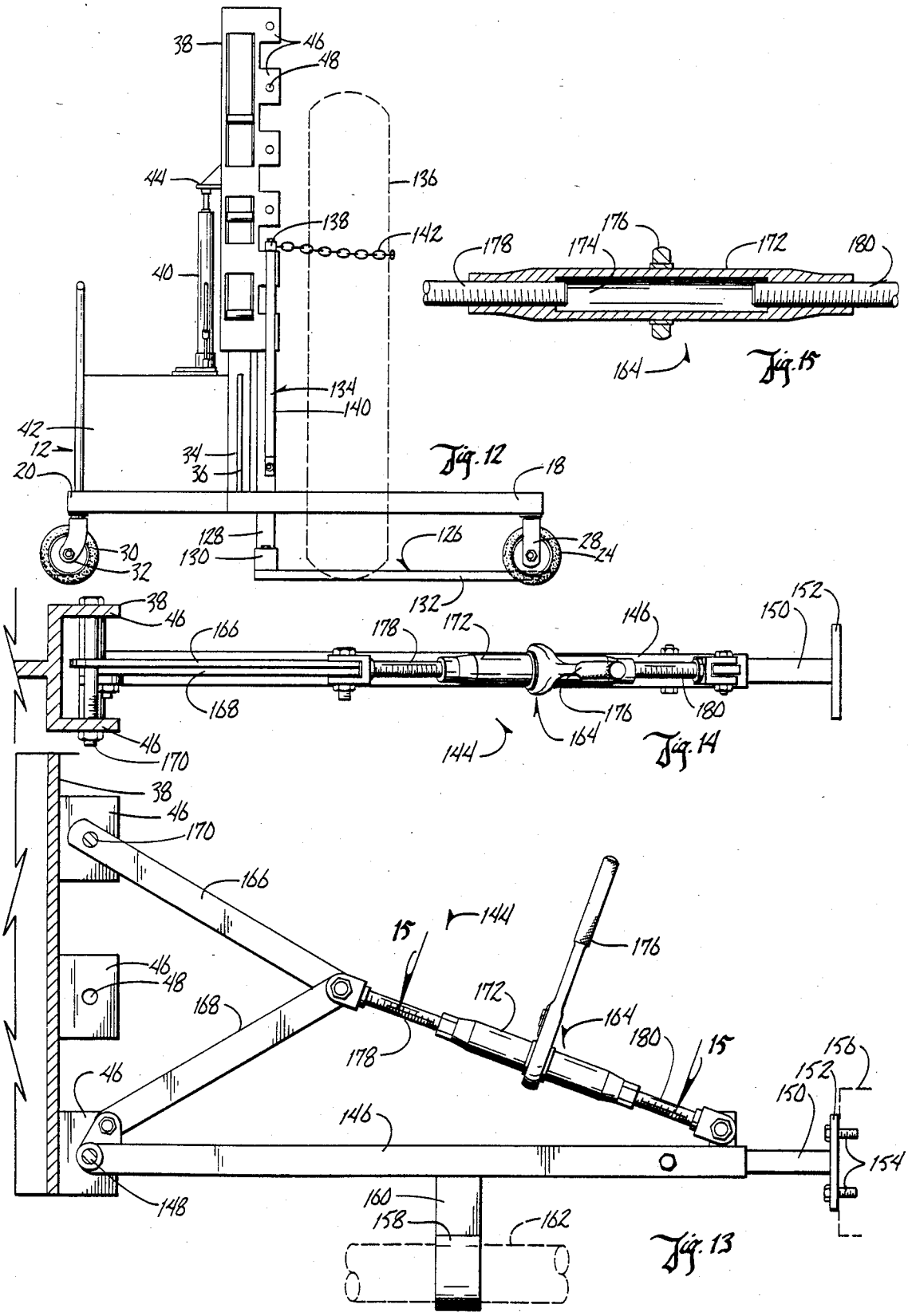
FIG. 12 is a side view of the embodiment of FIG. 11 showing its use for holding and supporting a vehicle tire.
FIG. 13 is a partial view of the embodiment of FIG. 1 with an elbow lift attachment tool.
FIG. 14 is a partial sectional and top view of the embodiment shown in FIG. 13.
FIG. 15 is a sectional view taken line 15—15 of FIG. 13.

The downwardly extending legs of yoke 32 are angled or curved from the vertical to cause wheel 30 to turn in the direction the invention 10 is pushed or pulled (see FIGS. 1, 9 and 12).

A mast 34 extends upwardly from the middle of center piece 14 and can have support pieces such as gusset 36 secured between it and center piece 14 for greater stability and strength. A masthead 38 is vertically movable along mast 34 by means of a jack 40 (see FIG. 3) which is secured at its lower end to platform member 42 on middle arm 20, and abuts at its top end projection 44 (see FIG. 3) from masthead 38.

A plurality of pairs of matching flanges 46 are secured along the length of masthead 38. Each flange 46 extends in the direction of end arms 16 and 18 from along an edge of masthead 38. Flanges 46 are evenly spaced along the length of the masthead 38 and have aligned apertures 48 to allow for the securement of accessory attachments at a selected position along masthead 38 by pins inserted therebetween.

Based framework 12 basically provides the mobile support for a variety of interchangeable tools which will be discussed below. The raising and lowering of masthead 38 is accomplished by operation of hydraulic jack 40. The extended vertical adjustability of masthead 38 depends directly upon the limits of extension of jack 40. Therefore, flanges 46 allow the user to selectively position the accessories at an initial height which is most advantageous and then be able to raise the whole masthead assembly 38 by jack 40. This allows for more flexibility for various uses.

It is also to be understood that steering of the base framework 12 is accomplished by pivoting of wheel 30. Wheel 30 could optionally attached to a steering bar so that it could be directly steered. Also, a manually operated brake could be installed for any of wheels 22, 24 or 30 to assist in control of the device when in motion or for keeping the device stationary on sloped surfaces.

A first accessory for use with base framework 12 is shown in FIGS. 2 and 3. A rotatable wheel support 49 is selectively secured to flanges 46 of masthead 38.

Two small tandem wheels 50 and 52 are rotatably secured to the outer end of rotatable wheel support 49. Tandem wheels 50 and 52 are positioned so that they are vertically upright in the same vertical plane, and have rotational axes in the same horizontal plane.

Rotatable wheels 50 and 52 are held in place by axles 54 and front and back plates 56 and 58, respectively.

Attachment to masthead 38 is accomplished by extension arm 60 and support arm 62. Both fit between a pair of flanges 46 and are secured there by a pin 66. An intermediate member 64 is positioned between the ends of support and extension arms 62 and 60 along the masthead 38 for additional support.

The dashed lines in FIGS. 2 and 3 depict a vehicle tire 68 having a rim 70. Tandem wheels 50 and 52 are moved into the cavity defined by rim 70 and then jack 40 is operated to bring wheels 50 and 52 into contact with the upper part of the rim. By continuing to raise jack 40, the vehicle tire is also raised.

Once the vehicle tire is completely removed from the vehicle, it is supported purely by tandem wheels 50 and 52 and can therefore be freely rotated. The tire 68 is balanced on wheels 50 and 52 and therefore the entire base framework 12 can be moved with the vehicle tire 68 intact.

By referring to FIGS. 4–8, another embodiment of the invention can be seen. A rotatable wheel support 72 is shown which operated essentially the same as that shown in FIGS. 2 and 3 but for the fact that its vertical adjustability is controlled by an external lifting and motive means.

To facilitate this, a framework 74 is constructed consisting of parallel side members 76, end cross members 78, cross supports 80 and reception member 82.

Figure 5:
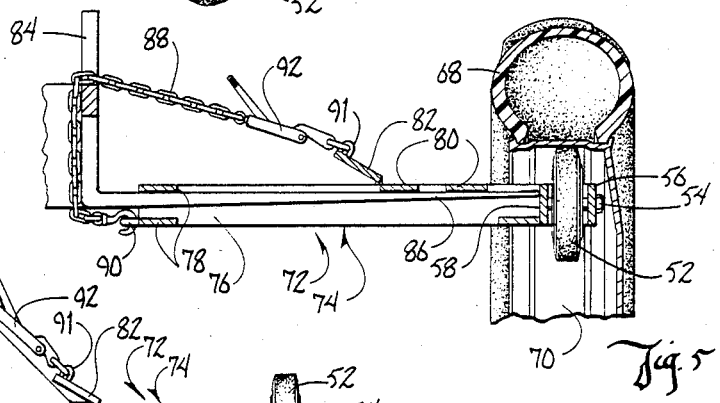
FIG. 5 is a partial sectional view of the tool of FIG. 4 showing its use with a conventional forklift lifting a vehicle tire.

FIG. 5 depicts the use of rotatable wheel support 72 with a conventional forklift 84 wherein tines 86 are inserted between end cross members 78 and side members 76. A chain 88 is attached between eye member 90 (which is secured to lower cross member 78) and is positioned over and around the forklift to where it is attached to eye members 91 on reception member 82. The chain is securely tightened by operation of load binder 92 disposed therebetween.

Figure 6:
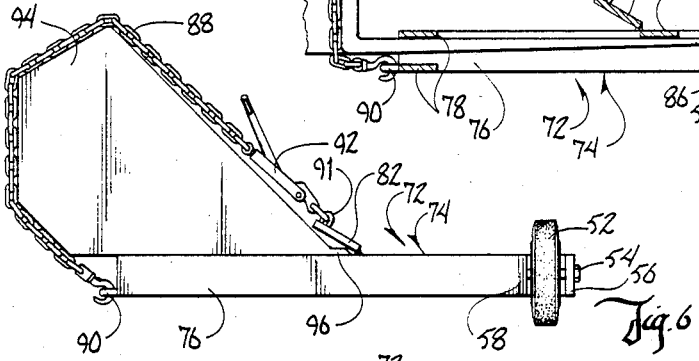
FIG. 6 is a side view of the invention of FIG. 4 showing its use with a conventional end loader.
Figure 7:
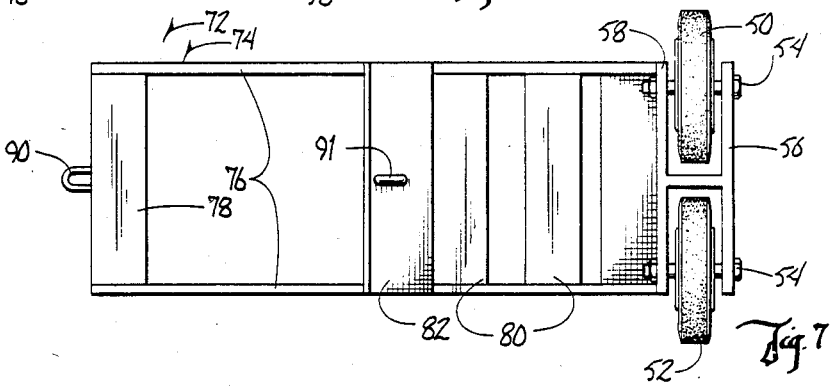
FIG. 7 is a top view of the device of FIG. 4.
Figure 8:
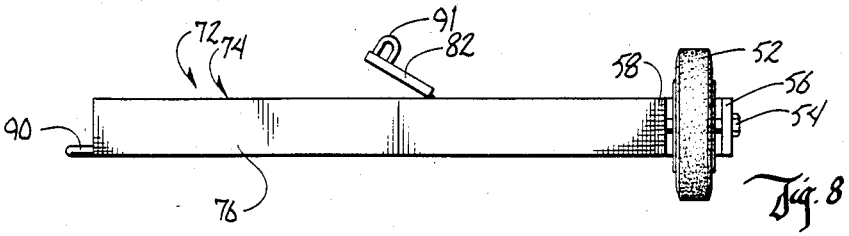
FIG. 8 is a side view of the device of FIG. 4.

FIG. 6 depicts the use of rotatable wheel support 72 with a conventional front end loader bucket 94. The front lip 96 of bucket 94 is wedged underneath reception member 82 and then chain 88 is secured around bucket 94 from eye member 90 to eye member 91 and tightened and secured by load binder 92.

Operation of rotatable wheel support 72 then is accomplished by positioning tandem wheels 50 and 52 by operation of an external lifting and motive means such as the hydraulically controlled lift means of a tractor or forklift tractor (not shown).

FIG. 9 depicts another accessory tool for operative attachment to base framework 12. A boom 98 having a vertical leg 100 which is secured to two or more of flanges 46 of masthead 38 is rigidly connected to a horizontal boom arm 102 which extends outwardly from masthead 38. A support member 104 extends between horizontal boom arm 102 and vertical member 100 for support. A cable 106 extends from the outer end of horizontal boom arm 102 and terminates in a hook member 108 which can be used to connect to selected objects to be raised and/or moved.

Figure 10:
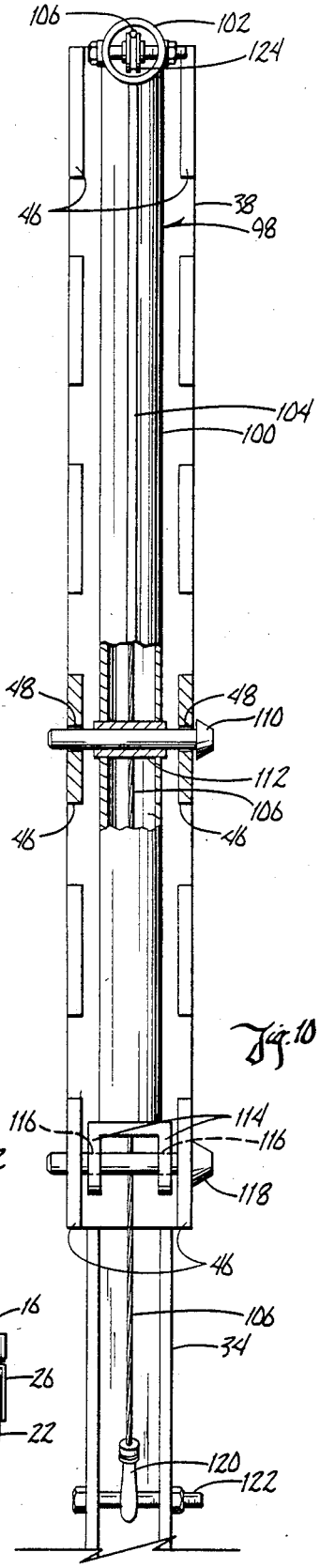
FIG. 10 is taken along line 10—10 of FIG. 9.

By referring to FIG. 10, the exact manner in which vertical member 100 is connected to masthead 38 is shown and the manner in which cable 106 is secured to boom 98 is shown. A pin 110 is inserted through a sleeve 102 which itself extends though vertical member 100. Pin 110 thus matches apertures 48 in a pair of flanges 46. At the lower end of vertical member 100, two flanges 114 with apertures 116 are mounted and a pin 118 extends through a pair of matching flanges 46 and through apertures 116. Cable 106 is secured at its lower end of mast 34 by means of hook 120 to a bolt 122 securely set within mast 34. Cable 106 thus runs through vertical member 100 and horizontal boom arm 102 and exits and extends over a pulley means 124 inserted at the end of horizontal boom arm 102.

Boom 98 thus can be used to hook onto an item and raise that item the distance to which jack 40 can be raised. By varying the length of cable 106 or by selected positioning of vertical member 100 against masthead 38, the position of hook member 108 can be varied.

Figure 11:
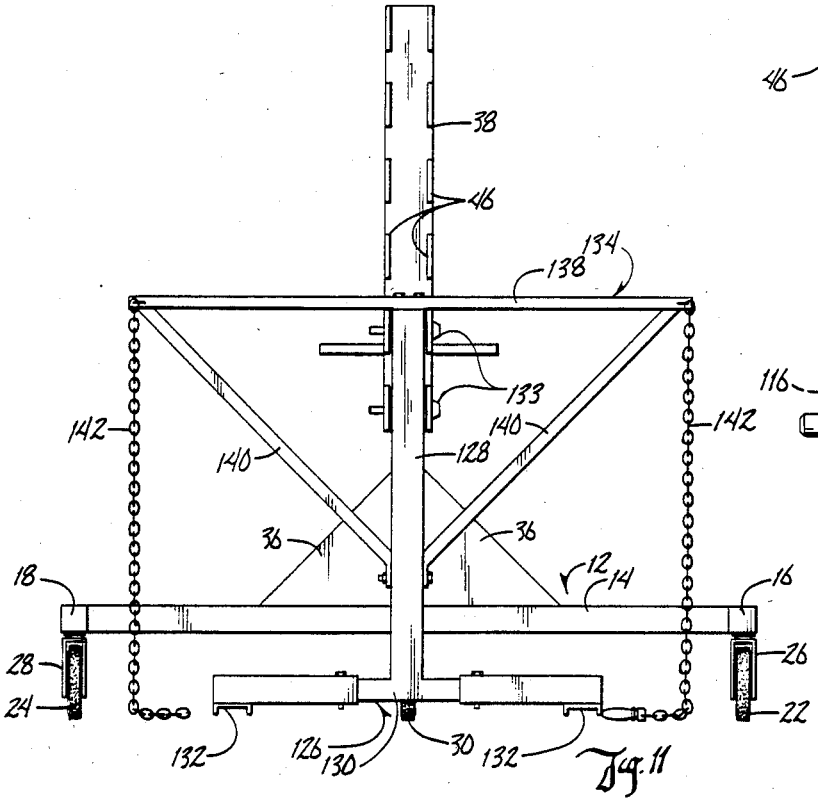
FIG. 11 is a front elevational view of the invention of FIG. 1 with a forklift tool attachment and a V-bar tool attachment.

FIGS. 11 and 12 depict another accessory tool for use with base framework 12. A fork 126 having a vertical member 128, a cross beam 130 and tines 132 is selectively securable to the flanges 46 of masthead 38 by pins 133 similar to that of vertical member 100 of the boom 98 in FIGS. 9 and 10. Vertical member 128 differs in that it extends downwardly along masthead 38 and mast 34 so that tines 132 can contact the ground. Fork 126 can be used to lift and move pallets or other wide items, and by additional use of optional V-bar 134, shown in FIGS. 11 and 12, an object such as a large vehicle tire 136 can be lifted, supported and secured.

V-bar 134 consists of a top cross bar 138 attached to vertical member 128 of fork 126, and then has V-shaped support bars 140 extending from the outermost ends of top crossbar 138 inwardly and downwardly to vertical member 128. Chains 142 are attached to the outermost ends of top crossbar 138, and as can be seen in FIG. 12, large vehicle tire 136 is cradled by tines 132 and held in place by securing chains 140 around tire 136.

A further additional accessory tool to be used with base framework 12 is depicted in FIGS. 13–15. An elbow lift 144 consists of a horizontal bar 146 which is pivotally attached to a pair of flanges 46 by a pin 148. Horizontal member 146 has a front extension piece 150 to which can be mounted machinery parts depicted by dashed lines 156 in FIG. 13. Additionally, horizontal arm 146 could have a ring member 158 mounted by mounting bar 160 to the underside of horizontal arm 146. Ring member 158 is used to support and retain articles such as axles or drive mechanisms depicted in dashed lines by 162.

Elbow lift 144 operates by means of ratchet mechanism 164. As shown in FIG. 13, ratchet mechanism 164 is hingably secured at its outer end to horizontal member 146. Its inner end is secured to two hingable bars 166 and 168. Hingable bar 166 is in turn hingably connected to flanges 46 by a pin 170 above the connection of horizontal arm 146 to masthead 38. Hingeable bar 168 is hingedly attached at its innermost end to horizontal bar 146.

By referring specifically to FIG. 15, it can be seen that ratchet mechanism 146 is comprised of a housing 172 having a channel 174 therethrough. The inner surfaces of the ends of housing 172 are threaded. Ratchet tool 176 is rigidly attached to housing 172. Threaded bars 178 and 180 are at their inner ends threadably insertable into threaded ends of housing 172 and are hingably attached to horizontal member 146 and hinged bars 166 and 168, respectively. It is to be understood that threaded bar 178 and 180 have opposite threads so that when ratchet tool 176 is turned, the bars 178 and 180 move in opposite directions, either inwardly or outwardly, thereby either raising or lowering horizontal bar 146.

Elbow lift 44 can have various grasping adapter plates or other devices attached to it for different applications. The operation of ratchet mechanism 164 allows for minute vertical positioning.

The included preferred embodiment is given by way of example only, and not by way of limitation to the invention, which is solely described by the claims herein. Variations obvious to one skilled in the art will be included within the invention defined by the claims.

What is claimed is:

1. A load handling attachment for lifting, supporting, lowering and transporting a vehicle tire having a rim, said attachment being readily removeably securable to and operable from an external motive and lifting means, comprising:

a framework having a top and bottom, and front, back, left and right sides;

a vehicle tire rim contacting and supporting means attached to said front of said framework comprising tandem rotatable wheels aligned in the same vertical plane and having rotational axes parallel to one another in the same horizontal plane, said wheels being horizontally spaced-apart but being located close together so as to be able to be placed within the recess of the tire rim so as to rollingly support the tire rim thereon, said tandem wheels being contactable with the interior of said rim of said vehicle tire to support said tire while allowing rotation of said tire;

a means for readily removably mounting said framework upon said external motive and lifting means; and a means for removably securing said framework to said external motive and lifting means.

2. The attachment of claim 1 wherein back side is comprised of two spaced apart horizontal members being secured at opposite ends to said left and right sides and leaving a uniform gap therebetween.

3. The attachment of claim 1 wherein said framework further comprises support members secured between sides of said framework.

4. The attachment of claim 1 wherein said external motive and lifting means comprises a conventional loader bucket attached to a hydraulic front end loader mechanism attached to a conventional motive means.

5. The attachment of claim 4 wherein said means for removably mounting upon said external motive and lifting means comprises a plate having a front and a back edge, said front edge being attached to and extending across said framework from said left to said right side, and being angularly oriented so that said back edge is raised from said front edge, so that said leading edge of said loader bucket can be matingly inserted and mounted therein.

6. The attachment of claim 4 wherein said means for securing said framework comprises a chain attached at one end to said means for removably mounting, and attached at said other end to said rear end of said framework, and having a means for releasably securing and tightening said chain disposed therebetween.

7. The attachment of claim 6 wherein said means for securing and tightening said chain comprises a conventional load binder mechanism.

8. The attachment of claim 1 wherein said external motive and lifting means comprises a forklift attached to a conventional lifting means.

9. The attachment of claim 8 wherein said means for removably mounting said external motive and lifting means comprises said horizontal spaced apart plates at said back side of said framework, so that said forklift can be inserted between said horizontal members.

10. The attachment of claim 8 wherein said means to secure said framework comprises a chain having a first end attached to said framework toward the front of said framework, and a second end attached to the rear of said framework below said horizontal members, and having a means to secure and tighten said chain disposed therebetween.

11. The attachment of claim 10 wherein said means to secure and tighten said chain comprises a conventional load binder.

12. The attachment of claim 4 wherein said conventional motive means comprises a conventional tractor.

13. The attachment of claim 8 wherein said conventional lifting means comprises a hydraulic front end lifter of a conventional tractor.

14. The attachment of claim 8 wherein said conventional lifting means comprises a conventional forklift truck.

* * * * *